US005835116A

United States Patent [19]

Sato et al.

[11] Patent Number: 5,835,116

[45] Date of Patent: Nov. 10, 1998

[54] IMAGE FORMING METHOD EMPLOYING INK-JET RECORDING SYSTEM

[75] Inventors: Shinichi Sato, Kawasaki; Shinichi Tochihara, Hadano; Yutaka Kurabayashi, Tokorozawa; Katsuhiko Takahashi, Yokohama; Masashi Ogasawara, Kawasaki, all of Japan

[73] Assignee: Canon Kabushiki Kaisha, Tokyo, Japan

[21] Appl. No.: 593,703

[22] Filed: Jan. 29, 1996

[30] Foreign Application Priority Data

Jan. 31, 1995 [JP] Japan ..... 7-032895

[51] Int. Cl.[6] ..... B41J 2/17

[52] U.S. Cl. ..... 347/98; 347/96; 106/31.43

[58] Field of Search ..... 347/95, 96, 98, 347/100, 105; 106/31.43

[56] References Cited

U.S. PATENT DOCUMENTS

| | | | |
|---|---|---|---|
| 4,196,437 | 4/1980 | Hertz | 347/98 |
| 4,538,160 | 8/1985 | Uchiyama | 346/140 R |
| 4,599,627 | 7/1986 | Vollert | 346/140 R |
| 4,630,076 | 12/1986 | Yoshimura | 346/140 R |
| 5,181,045 | 1/1993 | Shields et al. | 346/1.1 |
| 5,614,007 | 3/1997 | Kurabayashi et al. | 106/22 R |
| 5,623,294 | 4/1997 | Takizawa et al. | 347/98 |
| 5,635,969 | 6/1997 | Allen | 347/96 |
| 5,640,187 | 6/1997 | Kashiwazaki et al. | 347/101 |

FOREIGN PATENT DOCUMENTS

| | | |
|---|---|---|
| 0588316A2 | 3/1994 | European Pat. Off. . |
| 0596373A3 | 5/1994 | European Pat. Off. . |
| 53-24486 | 3/1978 | Japan . |
| 54-43733 | 4/1979 | Japan . |
| 55-150396 | 11/1980 | Japan . |
| 56-155260 | 12/1981 | Japan . |
| 56-155261 | 12/1981 | Japan . |
| 56-155262 | 12/1981 | Japan . |
| 58-128862 | 8/1983 | Japan . |
| 59-129272 | 7/1984 | Japan . |
| 2-276873 | 11/1990 | Japan . |

OTHER PUBLICATIONS

Susumu Harada, "Novel Reactive Polymer—Polyallylamine–", Function and Materials, vol. 5, No. 12, Dec., 1985, pp. 29–36.

*Primary Examiner*—Stuart N. Hecker

*Attorney, Agent, or Firm*—Fitzpatrick, Cella, Harper & Scinto

[57] ABSTRACT

An image forming method that forms an image using an ink and a liquid composition by a process comprising the steps of;

(A) imparting a black ink to an image forming area of a recording medium by ink-jet recording; the black ink comprising a water-soluble black dye and a black pigment as coloring matters, and a liquid medium in which the coloring matters are dissolved or dispersed; and (B) imparting a liquid composition different from the ink to the image forming area.

20 Claims, 3 Drawing Sheets

IMAGE FORMING METHOD EMPLOYING INK-JET RECORDING SYSTEM

BACKGROUND OF THE INVENTION

1. Field of the Invention

This invention relates to an image forming method that can obtain high-grade and highly water-fast recorded images on a recording medium, and more particularly to an image forming method employing an ink-jet recording system, that can obtain such good images at a high speed. This invention also relates to an image forming method that can be applied in all office machinery such as printers, copying machines and facsimile machines making use of various types of recording mediums such as paper, cloth, leather, non-woven fabric and OHP sheets.

2. Related Background Art

Ink-jet recording has been employed in printers, copying machines and so forth because of its various advantages such that it can enjoy low noise and low running cost, can achieve high-speed recording, makes it easy to design apparatus in a small size, and enables easy formation of color images. However, these apparatus employing the ink-jet recording have been involved in the problems that the resulting recorded images have an insufficient water-fastness and it is difficult to obtain images free of feathering and having a sufficient print density, when images are recorded on a recording medium called plain paper.

To cope with such problems, in recent years, inks containing a coloring matter which itself is endowed with a water-fastness are put into practical use as a means of improving the water-fastness of recorded images. They, however, still have an insufficient water-fastness. Also, such inks are, in principle, inks not readily soluble in water once they have dried, and hence tend to cause clogging of recording head nozzles. In order to prevent it, the apparatus necessarily require complicated assemblage. Such disadvantages remain unsettled.

A great number of techniques for improving fastness of recorded images have been disclosed. For example, Japanese Patent Application Laid-open No. 53-24486 discloses a technique in which dyed products are post-treated to convert the dye into a lake to fix so that the wet fastness of the dyed products can be promoted.

Japanese Patent Application Laid-open No. 54-43733 discloses a method in which images are recorded by ink-jet recording using at least two components whose film-forming abilities increase upon their mutual contact, at room temperature or when heated, where the components are brought into contact with each other on a recording medium to thereby obtain a print on which a film having firmly adhered has been formed and which has a good water-fastness. Japanese Patent Application Laid-open No. 55-150396 also discloses a method in which a water-resisting agent capable of forming a lake with the dye is imparted after ink-jet recording using a water-based dye ink.

Japanese Patent Application Laid-open No. 58-128862 also discloses an ink-jet recording method in which an ink containing a coloring matter and a liquid composition are superimposingly applied to record images while beforehand distinguishing positions at which the images are to be recorded. It discloses a method in which before an ink image is formed on a recording medium the liquid composition is applied to draw a base image; the liquid composition is superimposed on an ink image previously drawn, or the ink is superimposed on a liquid composition image previously drawn, to form an image, or the liquid composition is further superimposed on that image, to obtain an image improved in water-fastness.

With regard to the coloring matter constituting the ink used, studies are made on not only dyes but also pigments. Combination systems where a dye and a pigment are used in combination are also disclosed, e.g., in Japanese Patent Applications Laid-open No. 56-155260, No. 56-155261, No. 56-155262, No. 59-129272 and No. 2-276873, in each of which improvements of water-fastness and light-fastness are intended.

In these methods, however, when the liquid composition is used in dye type inks, there is a problem that the dye undergoes a change of color into a metallic glossy color as if it has crystallized, which is a phenomenon called bronzing.

This phenomenon remarkably occurs especially when black ink is used.

In the inks making use of a dye and a pigment in combination, weak points respectively inherent in the dye and the pigment (e.g., the problem on water-fastness and print quality in the case of the dye, and the problem on storage stability or fixing performance in the case of the pigment) are merely offset each other. Thus, the problems have not been fundamentally solved.

SUMMARY OF THE INVENTION

Accordingly, an object of the present invention is to provide an image forming method employing an ink-jet recording system and by which black recorded images having a high quality and a superior water-fastness and free of the bronzing can be formed on various types of recording mediums with high fixability.

The above object can be achieved by the invention described below. That is, the present invention provides an image forming method that forms an image using an ink and a liquid composition by a process comprising the steps of;

(A) imparting a black ink to an image forming area of a recording medium by ink-jet recording; the black ink comprising a water-soluble black dye and a black pigment as coloring matters, and a liquid medium in which the coloring matters are dissolved or dispersed; and (B) imparting a liquid composition different from the ink to the image forming area.

DESCRIPTION OF THE PREFERRED EMBODIMENTS

Figure 1:
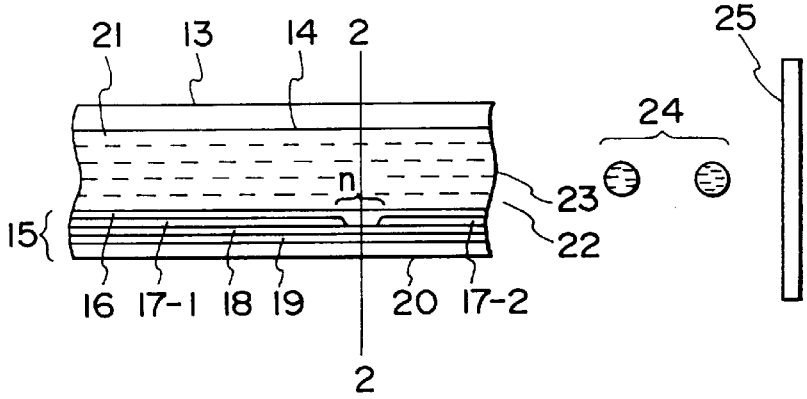
FIG. 1 is a longitudinal cross section of a head assembly of an ink-jet recording apparatus.

In the image forming method of the present invention, a black ink having both a black dye and a black pigment as coloring matters is used in combination with a liquid composition different from the black ink.

The present invention makes it possible to form on a recording medium of various types a black recorded image having a high quality and a superior water-fastness and free of bronzing. The reason therefor is still unknown in detail, but can be roughly presumed as follows:

In the present invention, the black ink having both a black dye and a black pigment is used in only combination with the liquid composition. This not mutually compensates for the disadvantages of both the dye and the pigment, but also causes the black dye to undergo a mutual action between the black pigment and a dispersant for the pigment to have the effect of preventing the bronzing that may occur when liquid compositions are used in black inks. Also, on plain paper, presumably because of a difference in the rate of permeation into plain paper between the black dye and the black pigment, the black pigment remains at the part nearer to the surface of the paper than the black dye does, and a good water-fastness and a good light-fastness inherent in the black pigment can be exhibited, so that the liquid composition can be effective without damaging the water-fastness and light-fastness of prints.

With regard to special papers such as glossy paper and back-print film, inks making use of black pigments usually have problems in fixing performance and uniformity. However, it is considered that the use of a black dye and a black pigment in combination makes it possible to achieve a good recording performance also on such special recording mediums.

The present invention will be described below in detail by giving preferred embodiments. The liquid composition used in the present invention will be described first.

The liquid composition may include any liquid compositions so long as they have the following two functions in a combination with a black ink, in which a water-soluble black dye and a black pigment are used concurrently.

(1) They improve the water-fastness of recorded images.

(2) They improve the print quality level of recorded images by particularly preventing a bronzing phenomenon.

As liquid compositions having these functions, liquid compositions containing at least one kind of cationic substance can be effective, and may preferably be used in the present invention.

In the present invention, the cationic substance incorporated in the liquid composition may include any substances without any particular limitations so long as they have a cationic group in the molecule. In particular, polyallylamine is preferred as a compound, and it is more preferred to use polyallylamine and a low-molecular weight cationic surface active agent in combination. Especially when the polyallylamine and the low-molecular weight cationic surface active agent are used in combination, bleeding at boundaries between different colors can be made to less occur in color recording, and hence it is preferable to use them in combination.

The low-molecular weight cationic surface active agent used in the present invention may include quaternary ammonium type compounds, and specifically cetyl trimethylammonium chloride, lauryl trimethylammonium chloride, lauryl dimethylbenzylammonium chloride, benzyl tributylammonium chloride, and benzalkonium chloride, but, in the present invention, of course not limited to these.

The ink used in the present invention to form recorded images will be described below. First of all, in the ink used in the present invention, a water-soluble black dye and a black pigment are used in combination. The water-soluble black dye and the black pigment in the ink may preferably be in a mixing proportion ranging from 1:1 to 5:1 in weight ratio. If the mixing proportion of the water-soluble black dye and the black pigment is lower than 1:1, the fixing performance of ink to recording mediums tends to be poor. If the proportion is higher than 5:1, bronzing tends to occur in ink images.

As the water-soluble black dye used in the present invention, it is preferable to use those having an anionic group as a solubilizing group. If so, an anionic group is combined with the cationic substance in the aforementioned liquid composition on a recording medium to form an agglomerate, so that water-fastness of an image obtained from a black ink is improved and feathering can be effectively prevented. In addition to such coloring matters, the ink used in the present invention may optionally further contain water, a water-soluble organic solvent and other components as exemplified by a viscosity modifier, a pH adjuster, an antifungal agent, a neutral or anionic surface active agent and an antioxidant, as in conventional inks.

As water-soluble black dyes having an anionic group, preferably used in the ink used in the present invention, there are no particular limitations thereon so long as they are water-soluble acid dyes, direct dyes or reactive dyes, stated specifically, those listed in COLOUR INDEX. Dyes not listed in COLOUR INDEX may also be used so long as they are those having an anionic group, e.g., a sulfonic group or a carboxyl group, without any particular limitations.

Two or more kinds of black dyes may also be used in combination as a mixture. In some cases, a color dye may also be used in a small quantity for the purpose of toning.

The water-soluble black dye herein referred to may of course also include those having a dependence of solubility on pH. Any of the dyes may be used in an amount ranging from 1 to 10% by weight, and preferably from 1 to 5% by weight, in the ink.

The black pigment used in combination with the water-soluble black dye described above may be used in an amount ranging from 1 to 20% by weight, and preferably from 2 to 12% by weight, based on the total weight of the ink. As a specific example of the black pigment used in the present invention, it may include carbon black, as exemplified by carbon black produced by the furnace process or the channel process. Those having a primary particle diameter of from 15 to 40 nm, a specific surface area of from 50 to 300 $m^2/g$ as measured by the BET method, a DBP oil absorption of from 40 to 150 ml/100 g, a volatile content of from 0.5 to 10%, a pH value of from 2 to 9 and so forth may particularly preferably be used. Commercially available products having such properties are exemplified by No. 2300, No. 900, MCF88, No. 33, No. 40, No. 45, No. 52, MA7, MA8, and No. 2200B (trade names; all available from Mitsubishi Chemical Industries Limited); RAVEN 1255 (trade name; available from Columbian Carbon Japan Limited); REGAL 400R, REGAL 330R, REGAL 660R, and MOGUL L (trade names; all available from Cabot Corp.); COLOR BLACK FW1, COLOR BLACK FW18, COLOR BLACK S170, COLOR BLACK S150, PRINTEX 35, and PRINTEX U (trade names; all available from Degussa Japan Co., Ltd.), any of which may preferably be used.

Also in a case of a black pigment-based ink, similar to a black dye-based ink, an aqueous liquid medium comprised of water and a water-soluble organic solvent, which are common ink components, and other components as exemplified by a viscosity modifier, an antifungal agent, a neutral or anionic surface active agent, an antioxidant and the like are used, as needed. However, in the black pigment-based ink, it is necessary to use a dispersing agent for dispersing a pigment uniformly in an ink.

As the dispersant incorporated in the ink in order to disperse the above black pigment in the ink, any water-soluble resins may be used. It is preferable to use those having a weight average molecular weight in the range of from 1,000 to 30,000, and more preferably from 3,000 to 15,000. Such dispersants may specifically include block copolymers, random copolymers or graft copolymers comprised of at least two monomers (at least one of which is a hydrophilic monomer) selected from styrene, styrene derivatives, vinyl naphthalene, vinyl naphthalene derivatives, aliphatic alcohol esters of ethylenically unsaturated $\alpha,\beta$-carboxylic acids, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acrylamide, and derivatives thereof; or salts of these. Natural resins such as rosin, shellac and starch may also preferably be used. These resins are alkali-soluble resins which are soluble in an aqueous solution in which a base has been dissolved. Any of these water-soluble resins used as dispersants for the pigment may preferably be contained in an amount ranging from 0.1 to 5% by weight based on the total weight of the ink.

In the case of the ink containing the pigment, it is preferable for the whole ink to be adjusted to neutrality or the alkaline side. That is, by doing so, the solubility of the water-soluble resin used as the pigment dispersant can be improved to obtain inks having a much better long-term storage stability. In this case, however, a too strongly alkaline dispersant may cause corrosion of various members used in ink-jet recording apparatus. Hence, the pH of the ink may preferably be adjusted in the range of from 7 to 10.

As pH adjusters used in such adjustment, they include, for example, various organic amines such as diethanolamine and triethanolamine, inorganic alkali agents including alkali metal hydroxides such as sodium hydroxide, lithium hydroxide and potassium hydroxide, and various organic acids and mineral acids. Under adjustment of the pH of ink in this way, the pigment and its dispersant water-soluble resin as described above can be well dispersed or dissolved in the aqueous medium to form the ink.

In the present invention, it is preferable to prepare a desired black ink, in which a water-soluble black dye and a black pigment are used in combination, by mixing a black dye-based ink and a black pigment-based ink in an appropriate proportion, after both inks has been prepared separately. In such a case above, a mixing ratio of a water-soluble black dye to a black pigment in a black ink is preferably to be within a range of from 1:1 to 5:1 by weight.

In the image forming method of the present invention, the liquid composition, which may be colorless or pale-colored and does not contain the coloring matters described above, and the black ink, which participates in image recording and contains the coloring matters, are applied to the surface of the recording medium so that they are present together in the image forming area.

How the liquid composition and the black ink are imparted to the recording medium in the present invention will be described below.

The image forming method according to the present invention is characterized by forming an image using the above ink and the above liquid composition by a process comprising the steps of (A) imparting the black ink to the image forming area of the recording medium by ink-jet recording; the black ink comprising the water-soluble black dye and the black pigment as coloring matters, and a liquid medium such as water in which the coloring matters are dissolved or dispersed; and (B) imparting the liquid composition, which is different from the ink, to the image forming area.

In the present invention, the image may be formed by any method so long as the liquid composition and the black ink for image recording which are constituted as described above can be present together in the image forming area on the recording medium. Thus, it does not matter which liquid composition or black ink is first imparted to the recording medium. Also, when, for example, the liquid composition is first applied to the recording medium, there are no particular limitations on the time of applying the black ink to the recording medium after the liquid composition has been applied to the recording medium. It is preferable to apply the both substantially simultaneously to the recording medium, or apply the black ink thereto in a few seconds after the liquid composition has been imparted.

In the present invention, as a method of forming the image, it is also preferable to use a recording method in which the recording of one pixel of the black ink is shared to a plurality of nozzles. In such a case, an image forming method can be exemplified in which the step (A) is first taken to impart the black ink, thereafter the step (B) is taken to impart the liquid composition, and further thereafter the step (A) is repeated to again impart the black ink.

As the recording medium used in the image forming method of the present invention, there are no particular limitations thereon. What is called plain paper such as copy paper and bond paper conventionally used may preferably be used. Of course, coated papers specially prepared for ink-jet recording or OHP transparent films may also preferably be used. Usual woodfree paper and glossy paper may still also preferably be used. Thus, the present method allows wide application.

As methods for applying the liquid composition the recording medium, one may contemplate spraying or use of a roller, by which the liquid composition is applied to the whole surface of the recording medium. However, ink-jet systems are preferred which can apply the liquid composition selectively and uniformly to only the image forming area to which the ink should be imparted, or only the image forming area and in the vicinity of the image forming area. In such an instance, various ink-jet recording systems may be used. It is particularly preferable to use a system of ejecting ink droplets by the aid of bubbles produced by heat energy.

Figure 2:
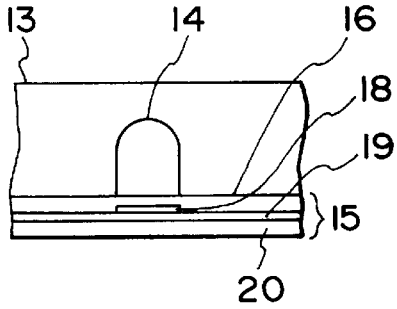
FIG. 2 is a transverse cross section of the head assembly of an ink-jet recording apparatus.
Figure 3:
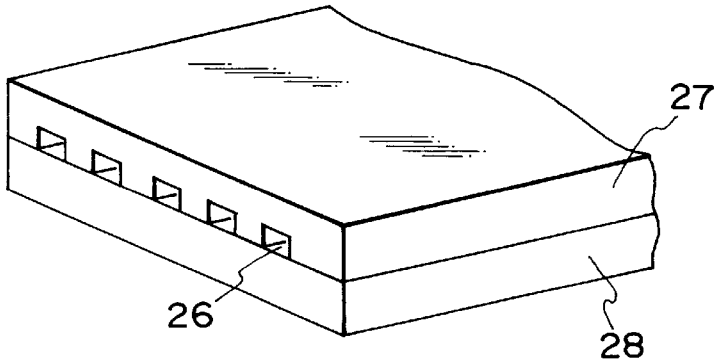
FIG. 3 is a perspective illustration of the appearance of a multi-head assembly comprised of the head assembly shown in FIG. 1.

A recording apparatus in which the ink droplets are produced by heat energy, which is preferable for the image forming method according to the present invention, will be described below. An example of an ink-jet recording apparatus preferable for the recording carried out using the black ink of the present invention will be described. FIGS. 1, 2 and 3 show examples of the construction of the recording head, which is a main component of the apparatus.

A head 13 is formed by bonding a glass, ceramic or plastic plate or the like provided with an ink flow path 14, to a heating head 15 used in thermal recording (the drawing shows a head, to which, however, the invention is not limited). The heating head 15 is comprised of a protective film 16 formed of silicon oxide or the like, aluminum electrodes 17-1 and 17-2, a heating resistor layer 18 formed of nichrome or the like, a heat accumulating layer 19, and a substrate 20 with good heat dissipation properties, made of alumina or the like.

The ink 21 stands reached an ejection orifice (minute opening) 22 and a meniscus 23 is formed there by a pressure P.

Now, upon application of electric signals to the aluminum electrodes 17-1 and 17-2, heat is abruptly generated at the region denoted by n in the thermal head 15, so that bubbles are generated in the ink 21 coming into contact with this region. The pressure thus produced thrusts out the meniscus 23 and the ink 21 is ejected from the orifice 22 in the form of minute ink drops 24 to fly against a recording medium 25.

FIG. 3 schematically illustrates a multi-head comprising the head as shown in FIG. 1 arranged in a large number. This multi-head is prepared by closely bonding a glass plate 27 having multiple grooves 26, to a heating head 28 similar to the head as illustrated in FIG. 1.

FIG. 1 is a cross-sectional view of the head 13 along its ink flow path, and FIG. 2 is a cross-sectional view along the line 2—2 in FIG. 1.

Figure 4:
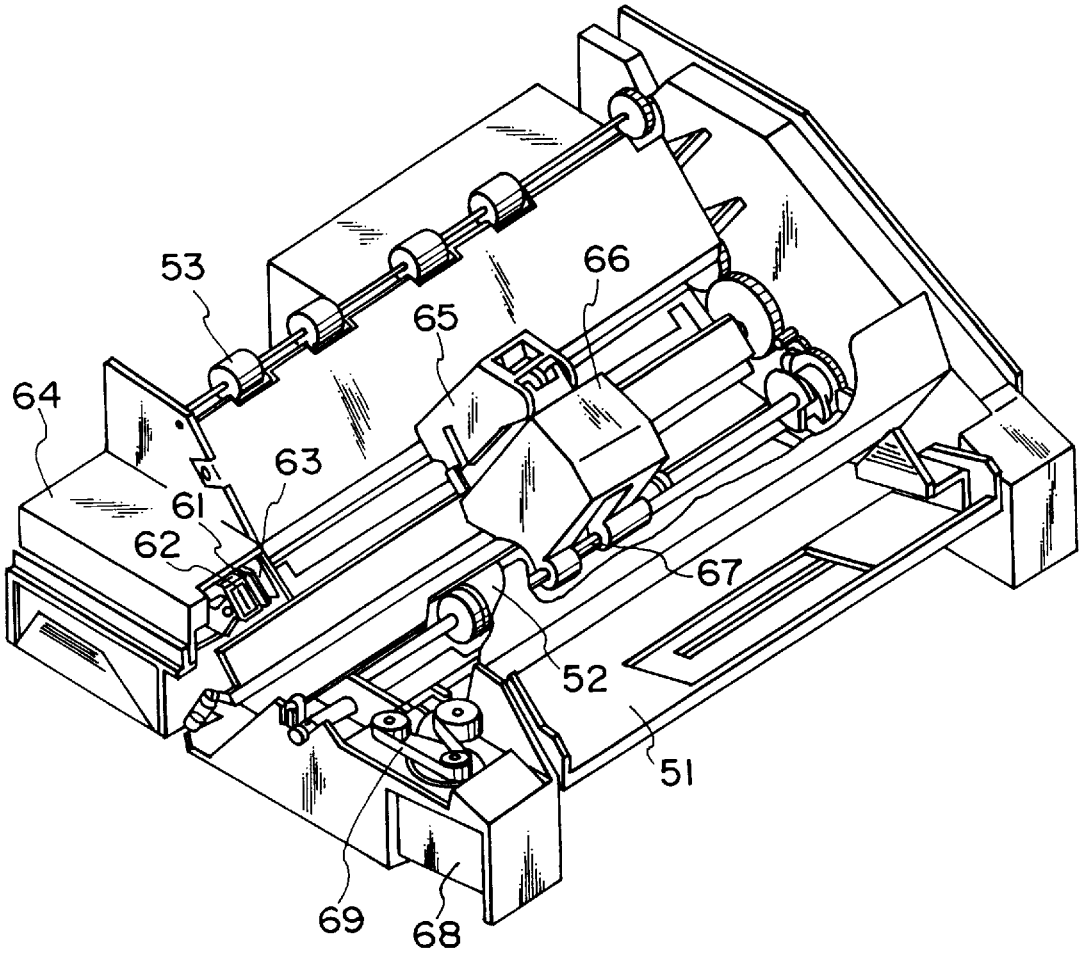
FIG. 4 is a perspective illustration of an example of an ink-jet recording apparatus.

FIG. 4 shows an example of the ink-jet recording apparatus in which such a head has been incorporated. In FIG. 4, reference numeral 61 denotes a blade serving as a wiping member in the form of a cantilever, one end of which is a stationary end retained by a blade-retaining member. The blade 61 is provided at the position adjacent to the region in which a recording head makes a record. In the present example, the blade is retained in such a form that it protrudes into the path through which the recording head 65 is moved.

Reference numeral 62 denotes a cap for the face of ink ejection openings of the recording head 65, which is provided at the home position adjacent to the blade 61, and is so constituted that it moves in the direction perpendicular to the direction in which the recording head is moved and comes into contact with the face of ink ejection openings to carry out capping. Reference numeral 63 denotes an ink absorber provided adjoiningly to the blade 61, and, similar to the blade 61, is retained in such a form that it protrudes into the path through which the recording head 65 is moved.

The above blade 61, cap 62 and absorber 63 constitute an ejection restoration assembly 64, where the blade 61 and the absorber 63 remove water, dust and so forth from the ink ejection opening face.

Reference numeral 65 denotes the recording head having an ejection energy generating means and ejects ink to the recording medium set opposingly to the ejection opening face provided with ejection openings, to carry out recording. Reference numeral 66 denotes a carriage on which the recording head 65 is mounted so that the recording head 65 can be moved.

The carriage 66 is slidably associated with a guide shaft 67. Part of the carriage 66 is connected (not shown) with a belt 69 driven by a motor 68. Thus, the carriage 66 can be moved along the guide 67 and hence the recording head 65 can be moved from a recording region to a region adjacent thereto.

Reference numeral 51 denotes a feeding part from which recording mediums are inserted, and 52, a feed roller driven by a motor (not shown). With such construction, the recording medium is fed to the position opposing to the ejection opening face of the recording head 65, and, with progress of recording, outputted from an output section provided with an output roller 53.

In the above constitution, the cap 62 of the head restoration assembly 64 is receded from the path of motion of the recording head 65 when the recording head 65 is returned to its home position, e.g., after completion of recording, and the blade 61 stands protruded into the path of motion. As the result, the ejection opening face of the recording head 65 is wiped. When the cap 62 comes into contact with the ejection opening face of the recording head 65 to carry out capping, the cap 62 is moved in such a way that it protrudes into the path of motion of the recording head.

When the recording head 65 is moved from its home position to the position at which recording is started, the cap 62 and the blade 61 are at the same position as the position where the ejection opening face is wiped. As the result, the ejection opening face of the recording head 65 is wiped also at the time of this movement.

The above movement of the recording head to its home position is made not only at the time of the completion of recording or restoration of ejection, but also when the recording head is moved between recording regions for the purpose of recording, during which it is moved to the home position adjacent to each recording region at given intervals, where the ejection opening face is wiped in accordance with this movement.

Figure 5:
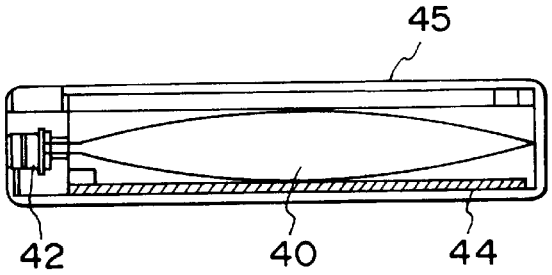
FIG. 5 is a longitudinal cross section of an ink cartridge.

FIG. 5 shows an example of an ink cartridge, denoted as 45, that has held the ink being fed to the head through an ink-feeding member, e.g., a tube. Here, reference numeral 40 denotes an ink holder, e.g., an ink bag, that has held the feeding ink. The top thereof is provided with a stopper 42 made of rubber. A needle (not shown) may be inserted to this stopper 42 so that the ink in the ink holder 40 can be fed to the head. Reference numeral 44 denotes an absorber that receives a waste ink.

In the present invention, it is preferable for the ink holder to be formed of a polyolefin, especially polyethylene, at its face coming into contact with ink.

Figure 6:
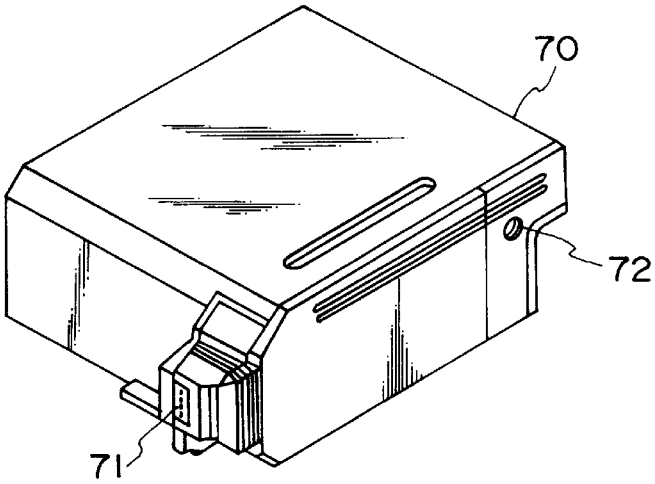
FIG. 6 is a perspective illustration of an example of a recording unit.

The ink-jet recording apparatus used in the present invention is not limited to the apparatus as described above in which the head and the ink cartridge are separately provided, and a device can also be preferably used in which these are integrally formed as shown in FIG. 6.

In FIG. 6, reference numeral 70 denotes a recording unit, in the interior of which an ink absorber that has held an ink is contained. The recording unit is so constructed that the ink in such an ink absorber is ejected in the form of ink droplets from a head 71 having a plurality of orifices.

As a material for the ink absorber, it is preferable in the present invention to use polyurethane, cellulose or polyvinyl acetal. Reference numeral 72 denotes an air path opening through which the interior of the cartridge is made to communicate with the atmosphere. This recording unit 70 can be used in place of the recording head shown in FIG. 3, and is detachably mounted to the carriage 66.

In the foregoing description, the recording apparatus used in the present invention is exemplified by the ink-jet recording apparatus in which heat energy is caused to act on the ink to eject ink droplets. Besides, it is possible to use a piezo type ink-jet recording apparatus employing a piezoelectric device.

Figure 7:
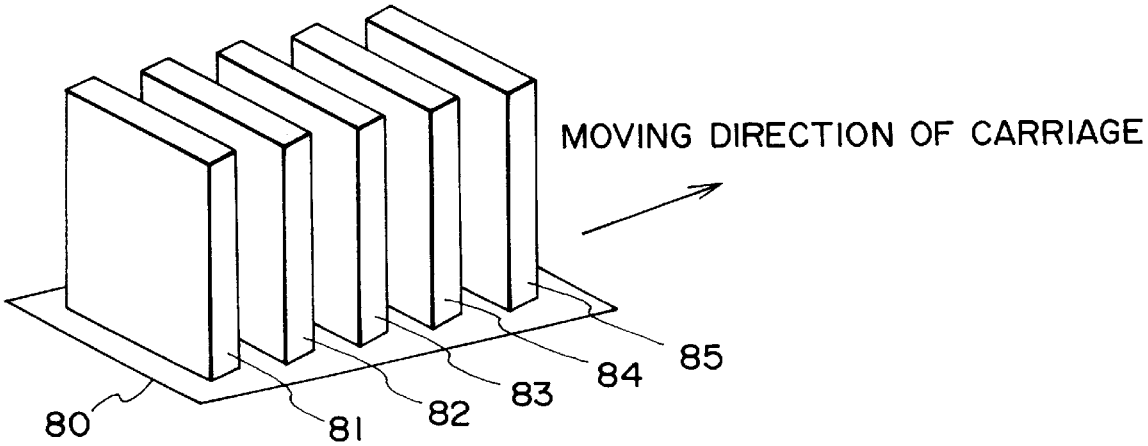
FIG. 7 is a perspective illustration of the recording section in which a plurality of recording heads used in the present invention are arranged.

The image forming method of the present invention can be used also for forming black image portions in a color image formation. However, in a case of performing color recording, a recording apparatus in which five recording heads comprising the recording head as previously shown in FIG. 3 are arranged on a carriage 80 is used, for example. FIG. 7 shows an example thereof. Reference numeral 80 denotes the carriage; and 81, a recording head for ejecting the liquid composition. Reference numerals 82, 83, 84 and 85 denote recording heads for ejecting a yellow ink, a magenta ink, a cyan ink and a black ink in which a water-soluble black dye, and a black pigment are contained in combination, respectively. The heads are provided in the recording apparatus described above, and eject the inks of respective colors in accordance with recording signals.

In this case, a color mixing due to bleed at boundaries between a black ink and other color inks can be suppressed, so that color images with high quality can be obtained.

The present invention will be described below in greater detail by giving Examples and Comparative Examples. In the following, "part(s)" and "%" are by weight unless particularly noted. With regard to the weight average molecular weight of the dispersant in the ink containing the pigment, it is measured by GPC using styrene polymer as a standard.

EXAMPLES 1 to 4

Comparative Example 1

Preparation of Black Ink

Using an anionic polymer P-1 (styrene-methacrylic acid-ethyl acrylate; acid value: 400; weight average molecular weight: 6,000; an aqueous solution with a solid content of 20%; neutralizer: potassium hydroxide) as a dispersant, materials as shown below were charged into a batch type vertical sand mill (manufactured by Aimex Co.), which was filled with glass beads of 1 mm diameter as media, and then dispersion treatment was carried out for 3 hours while water-cooling to produce a dispersion. The dispersion obtained after the treatment had a viscosity of 9 mN/m and a pH of 10.0. Using this dispersion, a carbon black dispersion having the composition as shown below was formed. After removing coarse particles by means of a centrifugal separator, a dispersion of carbon black with a weight average particle diameter of 100 nm was produced.

<Pigment Ink (carbon black dispersion)>

Composition:

| | |
|---|---|
| Aqueous P-1 solution (solid content: 20%) | 40 parts |
| Carbon black MOGUL L (trade-name, available from Cabot Co.) | 12 parts |
| Glycerol | 15 parts |
| Ethylene glycol monobutyl ether | 0.5 part |
| Isopropyl alcohol | 3 parts |
| Water | 135 parts |

The dispersion thus obtained was further thoroughly stirred to obtain a pigment ink, Bk1 for ink-jet recording. This final preparation had a solid content of about 5.8%.

<Water-soluble Dye Ink A>

Composition:

| | |
|---|---|
| C.I. Food Black 2 | 4 parts |
| Glycerol | 10 parts |
| Thiodiglycol | 8 parts |
| Acetylenol EH (trade-name, available from Kawaken Fine Chemicals Co., Ltd.) | 0.05 part |
| Water | 77.95 parts |

from Kawaken Fine Chemicals Co., Ltd.) 0.05 part Water 77.95 parts

The above materials were mixed and thoroughly stirred, followed by adjustment of pH to about 9 using sodium hydroxide. Thereafter, the mixture obtained was filtered under pressure using FLUOROPORE FILTER (trade-name; available from Sumitomo Electric Industries, Ltd.) with a pore size of 0.22 $\mu$m to obtain a black dye ink, Bk2.

<Water-soluble Dye Ink B>

Composition:

| | |
|---|---|
| C.I. Direct Black 168 | 3 parts |
| Glycerol | 10 parts |
| Thiodiglycol | 8 parts |
| Isopropyl alcohol | 4 parts |
| Water | 75 parts |

The above materials were mixed and the procedure for the dye ink A was repeated to obtain a black dye ink, Bk3.

<Preparation of Pigment-Dye Combination Inks>

The black pigment ink (Bk1) and dye ink A (Bk2) obtained as described above were mixed in a weight ratio of 2:8 and thoroughly stirred to obtain an ink, Bk4, having both the pigment and the water-soluble dye, used in Examples of the present invention (dye:pigment=about 3:1).

The black pigment ink (Bk1) and dye ink A (Bk2) obtained as described above were also mixed in a weight ratio of 4:6 and thoroughly stirred to obtain an ink, Bk5, having both the pigment and the water-soluble dye, used in Examples of the present invention (dye:pigment=about 1:1).

The black pigment ink (Bk1) and dye ink A (Bk2) obtained as described above were still also mixed in a weight ratio of 12:88 and thoroughly stirred to obtain an ink, Bk6, having both the pigment and the water-soluble dye, used in Examples of the present invention (dye:pigment=about 5:1).

The black pigment ink (Bk1) and dye ink B (Bk3) obtained as described above were mixed in a weight ratio of 2:8 to obtain an ink, Bk7, having both the pigment and the water-soluble dye (dye:pigment=about 2:1).

Liquid Composition

The materials shown below were mixed and thoroughly stirred, and thereafter the mixture obtained was filtered under pressure using FLUOROPORE FILTER (trade name; available from Sumitomo Electric Industries, Ltd.) with a pore size of 0.22 $\mu$m to obtain a liquid composition, S1, having a pH of 7.

With regard to the polyallylamine, it was synthesized by the method described in Kinou-Zairyo (FUNCTIONAL MATERIALS) Vol. 5, 29 (1985).

Allylamine, the starting material, was neutralized with a concentrated hydrochloric acid to prepare allylamine hydrochloride, which was polymerized using 2,2'-azo-bis-(2-methylpropion amidine) as a polymerization initiator to prepare polyallylamine hydrochloride.

| | |
|---|---|
| Polyallylamine hydrochloride | 5 parts |
| Benzalkonium chloride (Cation G50; trade-name available from Sanyo Chemical Industries, Ltd.) | 1 part |
| Diethylene glycol | 15 parts |
| Water | 79 parts |

Image Formation

Using the respective inks made up as described above, and in combination with the liquid composition as shown in Table 1, ink-jet recording was performed under the conditions as shown in Table 1.

As a recording apparatus, an ink-jet recording apparatus was used, the apparatus being of the type in which two ink heads (360 dpi each) that impart heat energy to the ink in the recording head to eject the ink in the form of ink droplets are arranged in the direction of primary scan. Images were recorded on commercially available PPC paper, bond paper and recycled paper.

TABLE 1

| | | | Ejection quantity (pl/dot) | |
|---|---|---|---|---|
| | Black ink | Liquid composition | Ink | Liquid composition |
| Example: | | | | |
| 1 | Bk4 | S1 | 80 | 80 |
| 2 | Bk5 | S1 | 80 | 80 |
| 3 | Bk6 | S1 | 80 | 80 |
| 4 | Bk7 | S1 | 80 | 80 |
| Comparative Example: 1 | Bk2 | S1 | 80 | 80 |

Note:
In the table, the ejection quantity indicates an ejection volume per dot.

The respective recorded images thus obtained were evaluated in the following manner and according to the following criteria. As evaluation items, evaluation was made on 1) image density, 2) character quality level, 3) fixing performance, 4) water-fastness and 5) bronzing.

1) Image density:

Solid prints were formed using colorless liquid compositions and black inks, and the reflection densities of the prints thus formed and having been left to stand for 12 hours were measured using a reflection densitometer Macbeth RD915 (trade-name, manufactured by Macbeth Co.). Evaluated according to the criteria shown below.

AA: Reflection density is 1.35 or more in all instances.

A: Reflection density is 1.35 or more to less than 1.35 on some kinds of paper.

B: Reflection density is 1.2 or more to less than 1.3 on some kinds of paper.

C: Reflection density is less than 1.2 on some kinds of paper.

2) Character quality level:

Alphabetical and numerical characters were printed, and the prints were air-dried for 12 hours in a room to thereafter evaluate their print quality levels.

AA: Feathering is little seen on all kinds of paper.

A: Feathering slightly seen on some kinds of paper, but no problem in practical use.

B: Feathering is conspicuous on some kinds of paper, and problematic in practical use.

C: Feathering is conspicuous, and problematic in practical use.

3) Fixing performance:

Alphabetical and numerical characters and solid prints were formed on commercially available copy paper and bond paper, and thereafter another blank sheet of paper was put on the recorded images by its own weight. The length of time until the recorded images come to no longer transfer to the blank sheet of paper to no longer cause background staining was measured on the basis of the time at which the recording was completed, which was regarded as zero time. The time thus determined was used as a measure of fixing performance. Evaluation was made according to the following criteria.

AA: Fixing performance is less than 20 seconds.

A: Fixing performance is 20 seconds or more to less than 30 seconds.

B: Fixing performance is 30 seconds or more to less than 40 seconds.

C: Fixing performance is 40 seconds or more.

4) Water-fastness:

Black-ink solid prints and alphabetical and numerical characters were printed. The prints were left to stand for 1 hour, and then immersed in city water of 20° C. for 10 seconds. Thereafter, they were taken out of the water and left to air-dry as they were, to make visual evaluation of water-fastness. Criteria for the evaluation of water-fastness are as follows:

AA: Flow of recording materials to non-image areas is not seen, and background staining is little seen. Alphabetical and numerical characters also little blur.

A: Flow of recording materials to non-image areas slightly occurs, and alphabetical and numerical characters slightly blur, but on the levels not problematic in practical use.

C: Flow of recording materials to non-image areas seriously occurs, and background staining is conspicuous. Alphabetical and numerical characters also seriously blur.

5) Bronzing:

Solid prints were formed, and color tones of the images having been air-dried in a room for 12 hours were visually evaluated according to the following criteria.

AA: No bronzing occurs.

A: Bronzing appears to have slightly occurred, but no problem in practical use.

B: Bronzing appears to have slightly occurred, and is problematic in practical use.

C: Bronzing is conspicuous, and problematic in practical use.

In the foregoing evaluation tests, the areas where the liquid composition is imparted to the recording medium are the same as the areas where ink images are formed, and the liquid composition is shot in 1:1 correspondence in the areas where the ink is shot on the recording medium.

With regard to the above evaluation items, results of the evaluation on the images obtained in Examples 1 to 4 are shown in Table 2. As is clear from Table 2, images having all good fixing performance, character quality level, image density, water-fastness and anti-bronzing are obtained in Examples. In these Examples, results of bronzing were further excellent as compared with a result of Comparative Example 1, in which merely a black ink was used concurrently with a liquid composition.

TABLE 2

| | Image density | Character quality level | Fixing perform-ance | Water fastness | Bronz-ing |
|---|---|---|---|---|---|
| Example: | | | | | |
| 1 | AA | AA | AA | AA | AA |
| 2 | AA | AA | A | AA | AA |
| 3 | AA | AA | AA | AA | A |
| 4 | AA | AA | AA | AA | AA |

Examples 5 and 6

Using the ink of Example 1 and setting two black-ink heads each having an ejection quantity of 40 pl, recording at 80 pl was carried out by means of these two recording heads. In Example 5, recording was carried out in the order of the liquid composition, the Bk4 ink and the Bk4 ink; and in Example 6, in the order of the Bk4 ink, the liquid composition and the Bk4 ink. As the result, in either Example, the results as good as those in Example 1 were obtained.

As described above, according to the present invention, high-density and high-grade images free of the bronzing can be obtained on various types of recording mediums, in particular, images having superior fixing performance and water-fastness can be provided.

What is claimed is:

1. An image forming method for forming an image by employing an ink and a liquid composition containing a cationic substance, comprising the steps of:

(A) imparting a black ink to an image forming area of a recording medium by ink-jet recording; said black ink comprising a water-soluble black dye having an anionic group as a coloring material dissolved in the ink; and (B) imparting a liquid composition containing a cationic substance, the liquid composition being different from the black ink, to said image forming area, wherein said black ink further comprises a black pigment as a coloring material dispersed in the ink.

2. The image forming method according to claim 1, wherein said liquid composition contains no coloring matter.

3. The image forming method according to claim 1, wherein said liquid composition contains polyallylamine.

4. The image forming method according to claim 1, wherein said liquid composition contains a cationic surface active agent and polyallylamine.

5. The image forming method according to claim 1, wherein said step (B) is carried out by ink-jet recording.

6. The image forming method according to claim 1, wherein said water-soluble black dye and said black pigment in said ink are in a proportion ranging from 1:1 to 5:1 in weight ratio.

7. The image forming method according to claim 1, wherein said step (B) is carried out before the step (A).

8. The image forming method according to claim 1, wherein said step (B) is carried out after the step (A).

9. The image forming method according to claim 1, wherein said step (A), said step (B) and said step (A) are carried out in this order.

10. The image forming method according to claim 1, wherein said black pigment comprises carbon black.

11. The image forming method according to claim 1, wherein said ink further comprises a dispersant.

12. The image forming method according to claim 11, wherein said dispersant has a weight average molecular weight in the range of from 1,000 to 30,000.

13. The image forming method according to claim 12, wherein said dispersant has a weight average molecular weight in the range of from 3,000 to 15,000.

14. The image forming method according to claim 11, wherein said dispersant is a water-soluble resin.

15. The image forming method according to claim 14, wherein said water-soluble resin has a weight average molecular weight in the range of from 1,000 to 30,000.

16. The image forming method according to claim 15, wherein said water-soluble resin has a weight average molecular weight in the range of from 3,000 to 15,000.

17. The image forming method according to claim 14, wherein said water-soluble resin is selected from the group consisting of block copolymer, random copolymer or graft copolymer comprised of at least two monomers selected from styrene, styrene derivatives, vinyl naphthalene, vinyl naphthalene derivatives, aliphatic alcohol esters of ethylenically unsaturated $\alpha,\beta$-carboxylic acids, acrylic acid, acrylic acid derivatives, maleic acid, maleic acid derivatives, itaconic acid, itaconic acid derivatives, fumaric acid, fumaric acid derivatives, vinyl acetate, vinylpyrrolidone, acrylamide and derivatives thereof.

18. A recorded article on which black images are formed on a recording medium by means of an image forming method according to any one of claims 1, 2, 3 to 9 and 10 to 17.

19. A color ink-jet recording apparatus comprising a recording head containing a liquid composition which contains a cationic substance, and another recording head containing a black ink which contains a water-soluble black dye having an anionic group dissolved in the ink and a black pigment dispersed in the ink, both the recording heads being provided with means for ejecting the liquid composition and the ink, respectively.

20. The color ink-jet recording apparatus to claim 19, wherein the recording heads are controlled so that the liquid composition and the ink are contacted with each other on a recording medium.

* * * * *

UNITED STATES PATENT AND TRADEMARK OFFICE

CERTIFICATE OF CORRECTION

PATENT NO. : 5,835,116

DATED : November 10, 1998

INVENTOR(S) : SHINICHI SATO, ET AL.

It is certified that error appears in the above-identified patent and that said Letters Patent is hereby corrected as shown below:

ON THE COVER PAGE

Item [57] ABSTRACT

Line 3, "of;" should read --of:--.

IN THE DISCLOSURE

COLUMN 2:

Line 24, "offset" should read --offset against--.
Line 37, "of;" should read --of:--.

COLUMN 3:

Line 10, "not" should read --not only--.
Line 55, "less occur" should read --occur less--.

COLUMN 5:

Line 51, "has" should read --have--.

COLUMN 9:

Line 66, Entire line should be deleted.
Line 67, Entire line should be deleted.

UNITED STATES PATENT AND TRADEMARK OFFICE

CERTIFICATE OF CORRECTION

PATENT NO. : 5,835,116

DATED : November 10, 1998

INVENTOR(S) : SHINICHI SATO, ET AL.

It is certified that error appears in the above-identified patent and that said Letters Patent is hereby corrected as shown below:

COLUMN 14:

Lines 28 & 29, "claims 1, 2, 3 to 9 and 10 to 17" should read --claims 1 to 17.--.

Line 38, "apparatus" should read --apparatus according--.

Signed and Sealed this

Eighteenth Day of January, 2000

*Attest:*

Q. TODD DICKINSON

*Attesting Officer*

*Commissioner of Patents and Trademarks*